US008174210B2

(12) United States Patent
Delnoij

(10) Patent No.: US 8,174,210 B2
(45) Date of Patent: May 8, 2012

(54) ILLUMINATION SYSTEM WITH FOUR PRIMARIES

(75) Inventor: Roger Peter Anna Delnoij, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 405 days.

(21) Appl. No.: 12/517,810

(22) PCT Filed: Dec. 5, 2007

(86) PCT No.: PCT/IB2007/054933

§ 371 (c)(1),
(2), (4) Date: Jun. 5, 2009

(87) PCT Pub. No.: WO2008/072138

PCT Pub. Date: Jun. 19, 2008

(65) Prior Publication Data

US 2010/0308745 A1 Dec. 9, 2010

(30) Foreign Application Priority Data

Dec. 12, 2006 (EP) ..... 06125930

(51) Int. Cl.
*H05B 37/02* (2006.01)
*F21V 9/00* (2006.01)

(52) U.S. Cl. ..... 315/294; 315/312; 362/231; 362/555

(58) Field of Classification Search ..... 315/112, 315/219, 294, 297, 308, 312, 318, 324; 345/83, 345/590, 600, 601, 690; 362/231, 555
See application file for complete search history.

(56) References Cited

U.S. PATENT DOCUMENTS

| | | | | |
|---|---|---|---|---|
| 5,384,519 | A | 1/1995 | Gotoh | |
| 7,990,083 | B2 * | 8/2011 | Deurenberg et al. | 315/318 |
| 2004/0207341 | A1 | 10/2004 | Callahan | |
| 2005/0083341 | A1 | 4/2005 | Higgins et al. | |
| 2005/0200295 | A1 | 9/2005 | Lim et al. | |
| 2010/0207544 | A1 * | 8/2010 | Man et al. | 315/294 |

* cited by examiner

*Primary Examiner* — Vibol Tan
(74) *Attorney, Agent, or Firm* — Mark L. Beloborodov

(57) ABSTRACT

An illumination system (10), comprising:—four lamps (12A, 12B, 12C, 12D);—four lamp drivers (13A, 13B, 13C, 13D) capable of driving their corresponding lamps with respective dim factors (ξ1, ξ2, ξ3, ξ4);—a common controller (15) for controlling the dim factors of the respective lamps. The controller is responsive to an input signal indicating a target color point (T) having target chromaticity coordinates ($x_T$, $y_T$) and target brightness ($B_T$). The controller sets the dim factor (ξ4) of one lamp to be equal to 1, and calculates an optimum solution for the other three dim factors as a function of the target chromaticity coordinates ($x_T$, $y_T$), for the maximum allowed value of the luminance ($Y_{MAX}$) for which $0 \leqq \xi \leqq 1$ applies for each of said dim factors ($\xi 1_S$, $\xi 2_S$, $\xi 3_S$).

4 Claims, 3 Drawing Sheets

ILLUMINATION SYSTEM WITH FOUR PRIMARIES

FIELD OF THE INVENTION

The present invention relates in general to the field of lighting. More particularly, the present invention relates to an illumination device for generating light with a variable color.

BACKGROUND OF THE INVENTION

Illumination systems for illuminating a space or object with a variable color are generally known. Generally, such systems comprise a plurality of light sources, each light source emitting light with a specific color, the respective colors of the different light sources being mutually different. The overall light generated by the system as a whole is then a mixture of the light emitted by the several light sources. By changing the relative intensities of the different light sources, the color of the overall light mixture can be changed.

It is noted that the light sources can be of different type, such as for instance TL lamp, halogen lamp, LED, etc. In the following, simply the word "lamp" will be used, but this is not intended to exclude LEDs.

By way of an example of a variable color illumination system, an illumination system in a home, office, shops, restaurants, hotels, schools, hospitals, etc. is mentioned. The use of colors and color variation, in conjunction perhaps with seasons and/or events, may be beneficial for attracting attention of customers, for influencing the mood of customers, for creating a certain atmosphere, etc.

Typically, an illumination system comprises three lamps of single color, which will also be indicated as the primary lamps generating primary colors. Usually, these lamps are close-to-red (R), close-to-green (G), close-to-blue (B), and the system is indicated as an RGB system. For each lamp, the light intensity can be represented as a number from 0 (no light) to 1 (maximum intensity). A color point can be represented by three-dimensional coordinates ($\xi 1$, $\xi 2$, $\xi 3$), each coordinate in a range from 0 to 1 corresponding in a linear manner to the relative intensity of one of the lamps. The color points of the individual lamps can be represented as (1,0,0), (0,1,0), (0,0,1), respectively. These points describe a triangle in the color space. All colors within this triangle can be generated by the system by suitably setting the relative intensities $\xi 1$, $\xi 2$, $\xi 3$ of the respective lamps. More particularly, each color within this triangle can be obtained in one way only, as a unique combination of the relative intensities $\xi 1$, $\xi 2$, $\xi 3$ of the respective lamps.

It is also possible that an illumination system has four lamps with mutually different colors, i.e. four primaries. As a fourth lamp, a white lamp may be used, which will improve the light output for colors close to the white point, and which is typically used for systems that are mainly used for generating white light. It is also possible that an additional color is used. For instance in the case of fluorescent lamps, it is known to add a yellow lamp to widen the color gamut in the yellow region. Also in the case of fluorescent lamps, it is known to add a red neon lamp to compensate for the unsaturated red of fluorescent lamps; this will also widen the color gamut in the yellow region. In the case of a system with LEDs, it is known to add an amber lamp in order to improve the color rendering index.

In the case of a four-lamp system, the relative intensities of the respective lamps can be written as $\xi 1$, $\xi 2$, $\xi 3$, $\xi 4$. A complication in such case is that most colors (or even all colors) can be obtained not as a unique combination of the four relative intensities $\xi 1$, $\xi 2$, $\xi 3$, $\xi 4$: many such combinations are possible for resulting in the same mixed color.

Thus, if a user selects a certain desired output color, a problem is to find a set of relative intensities $\xi 1$, $\xi 2$, $\xi 3$, $\xi 4$ of the primary lamps. In prior art, there are several different approaches for solving this problem. For instance, it is possible to set one of the primaries to zero, so that the problem translates to a three-primary problem again. Or, it is possible to fix the ratio between the relative intensities of two primaries, to again obtain a problem with three variables. US-2005/00833ξ1-A1 discloses a complicated method based on defining several color triangles.

SUMMARY OF THE INVENTION

The prior art methods do not necessarily lead to a combination of intensities resulting in the largest intensity of the output light.

Accordingly, it is an objective of the present invention to provide an algorithm that results in a solution to the four-primaries problem having the highest intensity, or at least being very close to the highest intensity, or, conversely, a solution giving a required color with a required intensity at the lowest cost of energy.

According to an important aspect of the present invention, one of the primaries is set to maximum intensity; then the other three intensities are calculated. If it is required to obtain a lower intensity, all primary intensities are multiplied by the same factor smaller than one.

Further advantageous elaborations are mentioned in the dependent claims.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1:
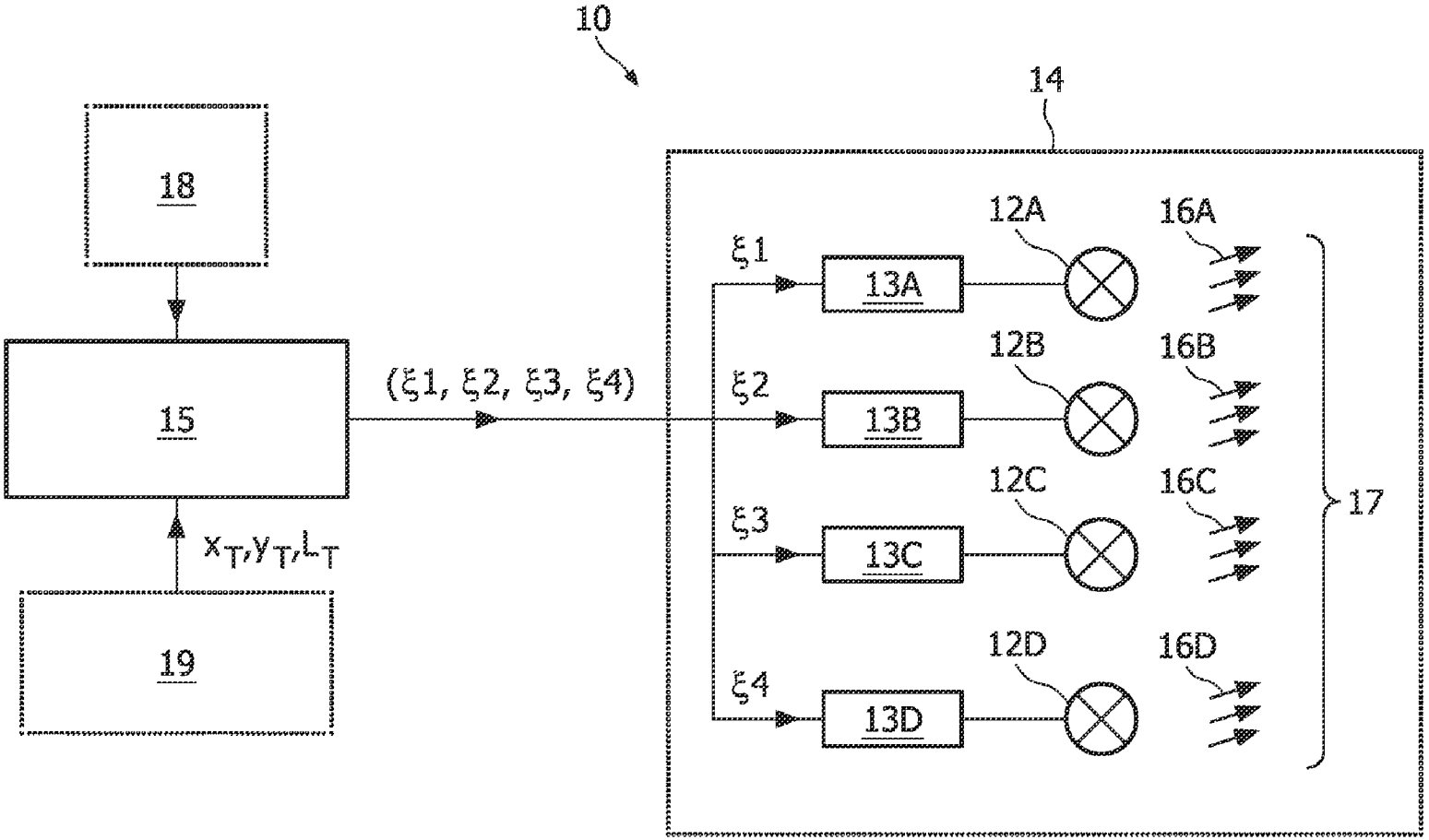
FIG. 1 schematically shows a block diagram of an illumination system according to the present invention.

FIG. 1 schematically shows a block diagram of an illumination system 10, comprising a lamp assembly 14. The lamp assembly 14 comprises four lamps 12A, 12B, 12C, 12D, for instance LEDs, each with an associated lamp driver 13A, 13B, 13C, 13D, respectively, controlled by a common controller 15. A user input device is indicated at 19.

The three lamps 12A, 12B, 12C, 12D generate light 16A, 16B, 16C, 16D, respectively, with mutually different light colors; typical colors used are red (R), green (G), blue (B). Instead of pure red, green and blue, the lamps will typically emit light close-to-red, close-to-green and close-to-blue. For sake of discussion, it will be assumed that the fourth lamp emits white light (W), but the invention is not restricted to this example. The overall light emitted by the lamp assembly 14 is indicated at 17; this overall light 17, which is a mixture of individual lights 16A, 16B, 16C, 16D, has a color determined by the mutual light intensities LI(R), LI(G), LI(B), LI(W) of the primary lamps 12A, 12B, 12C, 12D, which in turn are determined by control signals $\xi 1$, $\xi 2$, $\xi 3$, $\xi 4$ generated by the controller 15 for the respective drivers 13A, 13B, 13C, 13D.

It is noted that it is customary that each lamp is operated with a constant nominal lamp current, that is switched ON and OFF at a predetermined switching frequency, so that the duty cycle (i.e. the ratio between ON time and switching period) determines the average lamp power. The nominal lamp current being constant, the only control variable is the duty cycle, so the control signals ξ1, ξ2, ξ3, ξ4 may be considered as representing the duty cycles of the respective lamps. Thus, the control signals ξ1, ξ2, ξ3, ξ4 can only have values in the range from 0 to 1. If a control signal is equal to 0, the duty cycle is zero and the corresponding lamp is OFF. If a control signal is equal to 1, the duty cycle is 100% and the corresponding lamp is continuously ON, i.e. provides maximum or nominal output intensity NI(A), NI(B), NI(C), NI(D).

Colors can be represented by three mutually independent parameters. For explaining the present invention, reference will be made to the CIE1931(XYZ) system, which should be known to persons skilled in the art. X, Y, Z represent the intensities needed of light sources having particular defined colors, i.e. red 700 nm, green 546.1 nm, blue ξ35.8 nm, respectively, for obtaining a certain color. Here, "color" means a combination of chromaticity and brightness. In the CIE1931(XYZ) system, a change of one of the values of X, Y or Z will result in a combined change of chromaticity and brightness. A transformation can be made to a coordinate system where chromaticity and brightness are independent from each other. Such system is for instance the CIE(xyY) system, having coordinates x, y, Y, wherein x and y are chromaticity coordinates and wherein capital Y indicates luminance. The transformation regarding the color coordinates is defined by the following formulas:

$$x = \frac{X}{X+Y+Z} \tag{1a}$$

$$y = \frac{Y}{X+Y+Z} \tag{1b}$$

$$z = \frac{Z}{X+Y+Z} \tag{1c}$$

These formulas still show three variables x, y, z, but z is a redundant variable (i.e. not an independent variable) since z can be calculated from x and y according to $$Z=1-x-y \tag{1d}$$

Figure 2:
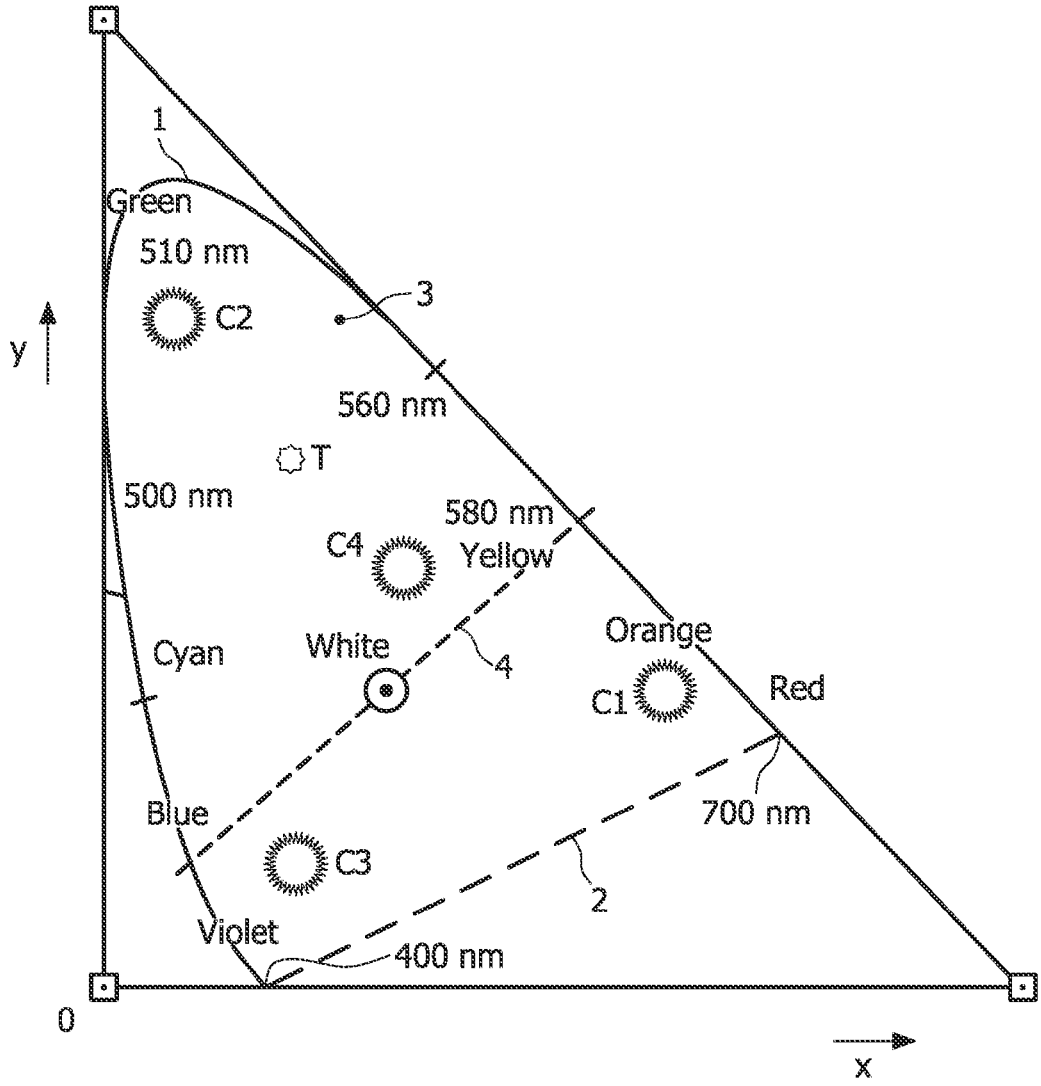
FIG. 2 schematically shows a chromaticity diagram.

Thus, the chromaticity of all colors can be represented in a two-dimensional xy-plane, as shown in FIG. 2, which schematically shows a CIE(xy) chromaticity diagram. This diagram is well-known, therefore an explanation will be kept to a minimum. Points (1,0), (0,0), and (0,1) indicate ideal red, blue and green, respectively, which are virtual colors. The curved line 1 represents the pure spectral colors. Wavelengths are indicated in nanometers (nm). A dashed line 2 connects the ends of the curved line 1. The area 3 enclosed by the curved line 1 and dashed line 2 contains all visible colors; in contrast to the pure spectral colors of the curved line 1, the colors of the area 3 are mixed colors, which can be obtained by mixing two or more pure spectral colors. Conversely, each visible color can be represented by coordinates in the chromaticity diagram; a point in the chromaticity diagram will be indicated as a "color point".

Instead of "luminance Y", which indicates an absolute amount of light, for instance expressed in lumen, it is customary in the field of light sources to use "brightness B", which is a relative parameter. For each color point (x,y), there is a maximum attainable luminance $Y_{MAX}(x,y)$. When the actual luminance Y has a value L, brightness is defined as $$B=L/Y_{MAX} \tag{2}$$

Thus, brightness is a value between 0 and 1.

Further, instead of color coordinates x,y it is also possible to use hue and saturation.

The basic concepts of Hue, Saturation and Brightness are most easily explained in the CIE 1931 (x,y) color space, referring to FIG. 2, although in other color spaces other definitions can be obtained. For simplicity, we use CIE 1931 (x,y) color space next.

When two pure spectral colors are mixed, the color point of the resulting mixed color is located on a line connecting the color points of the two pure colors, the exact location of the resulting color point depending on the mixing ratio (intensity ratio). For instance, when violet and red are mixed, the color point of the resulting mixed color purple is located on the dashed line 2. Two colors are called "complementary colors" if they can mix to produce white light. For instance, FIG. 2 shows a line 4 connecting blue (480 nm) and yellow (580 nm), which line crosses a white point, indicating that a correct intensity ratio of blue light and yellow light will be perceived as white light. The same would apply for any other set of complementary colors: in the case of the corresponding correct intensity ratio, the light mixture will be perceived as white light. It is noted that the light mixture actually still contains two spectral contributions at different wavelengths.

It is noted that many visible colors can be obtained by mixing two complementary colors, but this does not apply for all colors, as can easily be seen from FIG. 2. With three lamps producing three different colors, it is possible to produce light having any desired color within the triangle defined by the three corresponding color points. In case a fourth lamp is added, colors are no longer obtained as a unique combination of three light outputs but can be obtained in several different ways as combination of four light outputs.

In FIG. 2, four exemplary color points C1, C2, C3, C4 indicate respective colors close-to-red, close-to-green, close-to-blue and close-to-white of the four lamps 12A, 12B, 12C, 12D. In this example, C4 is located within the triangle defined by said points C1, C2, C3. With the system 10, it is possible to set the mixture color of the output light mixture 17 at any desired location within the triangle defined by said points C1, C2, C3, in many different ways. This can be shown as follows.

When emitting at full nominal power, each of the four lamps 12A, 12B, 12C, 12D contributes to the X, Y and Z coordinates of the color of the resulting mixed light output. The contributions of the first lamp 12A will be indicated as $X_R$, $Y_R$, $Z_R$; it is noted that these are constant values. When being operated at a duty cycle ξ1, the contributions of the first lamp 12A can be written as $\xi 1 \cdot X_R$, $\xi 1 \cdot Y_R$, $\xi 1 \cdot Z_R$.

Likewise, the contributions of the second lamp 12B can be written as $$\xi 2 \cdot X_G,\ \xi 2 \cdot Y_G,\ \xi 2 \cdot Z_G.$$

Likewise, the contributions of the third lamp 12C can be written as $$\xi 3 \cdot X_B,\ \xi 3 \cdot Y_B,\ \xi 3 \cdot Z_B.$$

Likewise, the contributions of the fourth lamp 12D can be written as $$\xi 4 \cdot X_W,\ \xi 4 \cdot Y_W,\ \xi 4 \cdot Z_W.$$

Thus, the total value of the X-coordinate can be written as $$X=\xi 1 \cdot X_R+\xi 2 \cdot X_G+\xi 3 \cdot X_B+\xi 4 \cdot X_W.$$

Likewise, the total value of the Y-coordinate can be written as $$Y=\xi 1\cdot Y_R+\xi 2\cdot Y_G+\xi 3\cdot Y_B+\xi 4\cdot Y_W.$$

Likewise, the total value of the Z-coordinate can be written as $$Z=\xi 1\cdot Z_R+\xi 2\cdot Z_G+\xi 3\cdot Z_B+\xi 4\cdot Z_W.$$

This can be written as $$\begin{pmatrix} X \\ Y \\ Z \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} \xi 1 \\ \xi 2 \\ \xi 3 \\ \xi 4 \end{pmatrix} \tag{3}$$

which, using formulas (1a)-(1c), can be rewritten as $$Y \cdot \begin{pmatrix} x/y \\ 1 \\ z/y \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} \xi 1 \\ \xi 2 \\ \xi 3 \\ \xi 4 \end{pmatrix} \tag{4}$$

Using formulas (1d) and (2), this can be rewritten as $$B \cdot Y_{MAX}(x, y) \cdot \begin{pmatrix} x/y \\ 1 \\ (1-x)/y-1 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} \xi 1 \\ \xi 2 \\ \xi 3 \\ \xi 4 \end{pmatrix} \tag{5}$$

A practical problem is as follows: how to calculate the lamp duty cycles ξ1, ξ2, ξ3, ξ4 if the user inputs a certain target color point, having target chromaticity coordinates $(x_T,y_T)$ and a target brightness $B_T$. Such target color point T is also shown in FIG. 2. Since the matrix in formulas (4) and (5) can not be inverted, the lamp duty cycles ξ1, ξ2, ξ3, ξ4 cannot be expressed as a function of the chromaticity coordinates and brightness, and there are different sets of lamp duty cycles [ξ1, ξ2, ξ3, ξ4] that will result in the same color point. The present invention aims to provide an algorithm that is capable of calculating target lamp duty cycles $\xi 1_T$, $\xi 2_T$, $\xi 3_T$, $\xi 4_T$ that are optimal as regards luminance, meaning that these target lamp duty cycles $\xi 1_T$, $\xi 2_T$, $\xi 3_T$, $\xi 4_T$ are capable of giving the highest value for the maximum $Y_{MAX}(x,y)$, which value will be indicated as optimum luminance $Y_{OPT}(x,y)$.

According to a first insight of the present invention, the lamp duty cycles can all be multiplied by the same factor without changing the chromaticity coordinates (x,y): such multiplication only results in a multiplication of the luminance. Thus, if a set of lamp duty cycles $[\xi 1_X, \xi 2_X, \xi 3_X, \xi 4_X]$ results in output light having the target chromaticity coordinates $(x_T,y_T)$ at luminance L1, the set of lamp duty cycles $[\alpha\cdot\xi 1_X, \alpha\cdot\xi 2_X, \alpha\cdot\xi 3_X, \alpha\cdot\xi 4_X]$ will also result in the same target chromaticity coordinates $(x_T,y_T)$, now at luminance L2=α·L1.

According to a second insight of the present invention, the optimum luminance $Y_{OPT}(x,y)$ is achieved when at least one of the lamp duty cycles is equal to 1. After all, if all lamp duty cycles are less than 1, it is possible to multiply them by a factor larger than 1 to increase the luminance while maintaining the chromaticity coordinates.

Based on this insight, the present invention proposes a calculation method in which one of the lamp intensities is taken to be fixed at maximum intensity. With this selection, the problem is reduced to a problem of three equations with three variables (i.e. the duty cycles of the three other lamps), which can be solved in a multiple ways for a requested combination of chromaticity coordinates $x_T,y_T$. The invention further provides a solution with which the largest luminance would be possible.

Thus, it is assumed that, via the user input 19, a user inputs a target color point T having target chromaticity coordinates $(x_T,y_T)$. In response, the controller 15, using the algorithm of the invention, calculates optimum values for the lamp duty cycles ξ1, ξ2, ξ3, ξ4. The user may also input a target brightness $B_T$, but this is not important at first, since this value can be incorporated later.

In a first step of the algorithm proposed by the present invention, one of the lamps is selected to be a basic lamp, and the lamp duty cycle of this basic lamp is selected to be equal to 1. In the following calculation, it will be assumed that the fourth lamp is selected as basic lamp. Further, the brightness B will be taken to be 1. Equation (5) then becomes $$Y_{MAX}(x, y) \cdot \begin{pmatrix} x/y \\ 1 \\ (1-x)/y-1 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} \xi 1 \\ \xi 2 \\ \xi 3 \\ 1 \end{pmatrix} \tag{6}$$

or $$Y_{MAX}(x, y) \cdot \begin{pmatrix} x/y \\ 1 \\ (1-x)/y-1 \end{pmatrix} = \begin{pmatrix} X_R & X_G & X_B \\ Y_R & Y_G & Y_B \\ Z_R & Z_G & Z_B \end{pmatrix} \cdot \begin{pmatrix} \xi 1 \\ \xi 2 \\ \xi 3 \end{pmatrix} + \begin{pmatrix} X_W \\ Y_W \\ Z_W \end{pmatrix} \tag{7}$$

Now it is possible to write the lamp duty cycles as a function of $x_T$, $y_T$ and $Y_{MAX}$, as follows:

$$\begin{pmatrix} \xi 1 \\ \xi 2 \\ \xi 3 \end{pmatrix} = \begin{pmatrix} X_R & X_G & X_B \\ Y_R & Y_G & Y_B \\ Z_R & Z_G & Z_B \end{pmatrix}^{-1} \cdot \begin{pmatrix} Y_{MAX}(x, y)\cdot x_T/y_T - X_W \\ Y_{MAX}(x, y) - Y_W \\ Y_{MAX}(x, y)\cdot((1-x_T)/y_T-1) - Z_W \end{pmatrix} \tag{8}$$

It should be noted that $Y_{MAX}(x,y)$ is not inputted by the user, but is an unknown. Thus, with $x_T$ and $y_T$ being kept constant, equation (8) can be considered as being a combination of three separate equations, separately expressing ξ1, ξ2 and ξ3 as a function of $Y_{MAX}$:

$$\xi 1=f_1(Y_{MAX}) \tag{9a}$$

$$\xi 2=f_2(Y_{MAX}) \tag{9b}$$

$$\xi 3=f_2(Y_{MAX}) \tag{9c}$$

Figure 3:
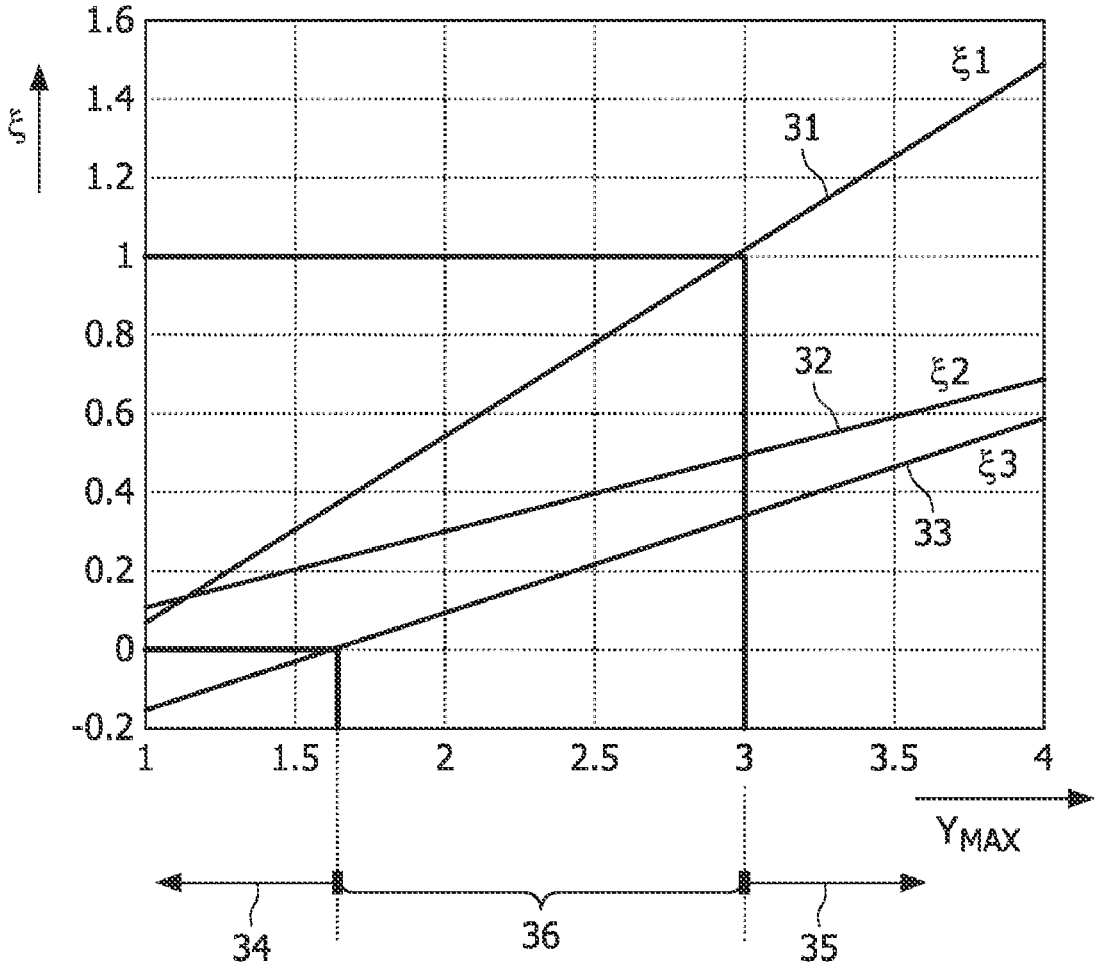
FIG. 3 is a graph illustrating an exemplary relationship between duty cycles and maximum luminance.

It is noted that these functions are linear functions. FIG. 3 is a graph in which the vertical axis represents duty cycle while the horizontal axis represents $Y_{MAX}$. The figure illustratively shows three exemplary lines 31, 32, 33 for ξ1, ξ2, ξ3, respectively. Basically, the figure illustrates that for each value of $Y_{MAX}$ there exists a combination of ξ1, ξ2, ξ3 satisfying equation (8).

However, not all combinations are allowed. A first restriction is that all values of ξ should be 0 or higher, which excludes all values of $Y_{MAX}$ for which at least one of the ξ's has a value lower than 0. In FIG. 3, the excluded range of values of $Y_{MAX}$ is indicated at 34. A second restriction is that all values of ξ should be 1 or lower, which excludes all values of $Y_{MAX}$ for which at least one of the ξ's has a value higher than 1. In FIG. 3, the excluded range of values of $Y_{MAX}$ is indicated at 35. The allowed range of values of $Y_{MAX}$, where $0 \leqq \xi \leqq 1$ applies for each of $\xi 1$, $\xi 2$, $\xi 3$, is indicated at 36.

In view of the fact that the present invention aims to provide a solution with maximum luminance, the solution for $Y_{MAX,S}$ is the highest value within said allowed range 36.

This results in three solutions for the values $\xi 1_S$, $\xi 2_S$ and $\xi 3_S$, according to equations (10a)-(10c):

$$\xi 1_S(4)=f_1(Y_{MAX,S}) \tag{10a}$$

$$\xi 2_S(4)=f_2(Y_{MAX,S}) \tag{10b}$$

$$\xi 3_S(4)=f_3(Y_{MAX,S}) \tag{10c}$$

one of these solution values being equal to 1 in this example.

In the above equations, the index 4 indicates that these solutions have been obtained by selecting $\xi 4$ to be equal to 1. The corresponding maximum luminance will be indicated as $Y_{MAX}(4)$.

The above procedure is repeated three times, each time choosing another one of the lamp duty cycles to be equal to 1.

When $\xi 1$ is selected to be equal to 1, the resulting solutions for the other three lamp duty cycles are indicated as $\xi 2_S(1)$, $\xi 3_S(1)$, $\xi 4_S(1)$, and the resulting maximum luminance will be indicated as $Y_{MAX}(1)$.

When $\xi 2$ is selected to be equal to 1, the resulting solutions for the other three lamp duty cycles are indicated as $\xi 1_S(2)$, $\xi 3_S(2)$, $\xi 4_S(2)$, and the resulting maximum luminance will be indicated as $Y_{MAX}(2)$.

When $\xi 3$ is selected to be equal to 1, the resulting solutions for the other three lamp duty cycles are indicated as $\xi 1_S(3)$, $\xi 2_S(3)$, $\xi 4_S(3)$, and the resulting maximum luminance will be indicated as $Y_{MAX}(3)$.

The four maximum luminances thus obtained are compared, and the highest one is selected, expressed as $$Y_{OPT}=\mathrm{MAX}(Y_{MAX}(1),Y_{MAX}(2),Y_{MAX}(3),Y_{MAX}(4))$$

and the selected solutions $\xi 1_S$, $\xi 2_S$, $\xi 3_S$, $\xi 4_S$ are the ones corresponding to this selected luminance.

The above solutions $\xi 1_S$, $\xi 2_S$, $\xi 3_S$, $\xi 4_S$ are the ones resulting in the target color point (x,y) at the highest luminance. If the user has also set a target brightness $B_T$, this is achieved by multiplying the selected solutions $\xi 1_S$, $\xi 2_S$, $\xi 3_S$, $\xi 4_S$ by $B_T$, according to equations (11a)-(11d)

$$\xi 1_T=B_T \cdot \xi 1_S \tag{11a}$$

$$\xi 2_T=B_T \cdot \xi 2_S \tag{11b}$$

$$\xi 3_T=B_T \cdot \xi 3_S \tag{11c}$$

$$\xi 4_T=B_T \cdot \xi 4_S \tag{11d}$$

The controller 15 uses these values for controlling the drivers 13A, 13B, 13C, 13D.

In the above embodiment, the calculations are performed four times, while each time a different one of the lamps is fixed at maximum light output, and then the best one of the four results is determined. In a preferred embodiment, it is determined in advance which one of the lamps should be fixed at maximum light output in order to obtain the optimum result, so that the calculations need to be performed only once.

This aspect of the present invention is based on the insight that those lamps having a color point closest to the target color point are the lamps that contribute the most to the mixed output light 17. Therefore, it is expected that, at maximum luminance, these lamps are the lamps that operate at full power.

Therefore, in this preferred embodiment, in a first step it is determined which lamp is closest to the target color point. This determination is performed using a weighed distance formula (12) for the distance $\Delta(i)$ between the target color point and the color point of the i-th lamp $$\Delta(i)=L(i)\cdot\sqrt{(x_T-x(i))^2+(y_T-y(i))^2} \tag{12}$$

in which $x_T$ and $y_T$ indicate the target chromaticity coordinates, x(i) and y(i) indicate the chromaticity coordinates of the i-th lamp, and L(i) indicates the maximum intensity of the i-th lamp.

The lamp for which $\Delta(i)$ yields the lowest value will be selected as the "fourth" lamp whose duty cycle $\xi 4_S$ will be set equal to 1 in formula (6). Then, the values $\xi 1_S$, $\xi 2_S$ and $\xi 3_S$ according to equations (10a)-(10c) are calculated, and all these values are possibly multiplied by $B_T$ according to equations (11a)-(11d).

Summarizing, the present invention provides an illumination system 10, comprising:

- four lamps 12A, 12B, 12C, 12D;
- four lamp drivers 13A, 13B, 13C, 13D capable of driving their corresponding lamps with respective dim factors $\xi 1$, $\xi 2$, $\xi 3$, $\xi 4$;
- a common controller 15 for controlling the dim factors of the respective lamps.

The controller is responsive to an input signal indicating a target color point T having target chromaticity coordinates $(x_T,y_T)$ and target brightness $L_T$.

The controller sets the dim factor $\xi 4$ of one lamp to be equal to 1, and calculates an optimum solution for the other three dim factors as a function of the target chromaticity coordinates $(x_T,y_T)$, for the maximum allowed value of the luminance $(Y_{MAX})$ for which $0 \leqq \xi \leqq 1$ applies for each of said dim factors $(\xi 1_S, \xi 2_S, \xi 3_S)$.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For instance, in the above-described exemplary embodiment it is assumed that the target values for the chromaticity are inputted by a user; however, it is also possible that the illumination system receives commands from a central system such as for instance DALI or DMX.

Further, it is possible that, for a certain lamp being selected as basic lamp, no solution for $\xi 1$, $\xi 2$, $\xi 3$ is possible. In that case, the corresponding maximum luminance $Y_{MAX}$ can be set equal to 0.

Further, it is possible that the system comprises a feedback facility, providing feedback signals to the controller indicating the actual light output, so that the controller may adapt its control signals.

Further, it is possible that a lamp 12A, 12B, 12C, 12D actually consists of a plurality of elementary lamps operated in parallel, for increasing the intrinsic intensity of such lamp.

Further, although the principle of the invention has been described for a system where lamp intensity is controlled by varying the duty cycle, it is also possible to use the present invention in systems where lamp intensity is controlled in a different way, for instance by varying the lamp current. Therefore, instead of the wording "duty cycle", the more general wording "dim factor" will be used in the claims.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. Illumination system, comprising:

four lamps, each lamp generating light with a respective color point having color coordinates and having a nominal output intensity;

four lamp drivers associated with the respective lamps, each lamp driver capable of driving its corresponding lamp with a dim factor ($\xi 1$, $\xi 2$, $\xi 3$, $\xi 4$);

a common controller for generating control signals for the lamp drivers such as to control the dim factors ($\xi 1$, $\xi 2$, $\xi 3$, $\xi 4$) of the respective lamps;

wherein the controller is responsive to an input signal indicating a target color point (T) having target chromaticity coordinates by calculating target dim factors ($\xi 1_T$, $\xi 2_T$, $\xi 3_T$, $\xi 4_T$) and using these values for controlling the drivers;

wherein the controller is designed to select one of the lamps to be a basic lamp, to set the dim factor ($\xi 4$) of this basic lamp to be equal to 1, to calculate an optimum solution for the other three dim factors ($\xi_S$, $\xi 2_S$, $\xi 3_S$) as a function of the target chromaticity coordinates, for the maximum allowed value of the luminance for which $0 \leqq \xi \leqq 1$ applies for each of said dim factors ($\xi 1_{s,\xi 2s,\ \xi 3s}$);

wherein the controller is responsive to an input signal indicating a target brightness ($B_T$) by calculating said target dim factors ($\xi 1_T$, $\xi 2_T$, $\xi 3_T$, $\xi 4_T$) according to ($\xi 1_T = B_T \cdot \xi 1_S$, $\xi 2_T = B_T \cdot \xi 2_S$, $\xi 3_T = B_T \cdot \xi 3_S$, $\xi 4_T = B_T \cdot \xi 4_S$.

2. Illumination system, comprising:

four lamps, each lamp generating light with a respective color point having color coordinates and having a nominal output intensity;

four lamp drivers associated with the respective lamps, each lamp driver capable of driving its corresponding lamp with a dim factor ($\xi 1$, $\xi 2$, $\xi 3$, $\xi 4$);

a common controller for generating control signals for the lamp drivers such as to control the dim factors ($\xi 1$, $\xi 2$, $\xi 3$, $\xi 4$) of the respective lamps;

wherein the controller is responsive to an input signal indicating a target color point (T) having target chromaticity coordinates by calculating target dim factors ($\xi 1_T$, $\xi 2_T$, $\xi 3_T$, $\xi 4_T$) and using these values for controlling the drivers;

wherein the controller is designed to select one of the lamps to be a basic lamp, to set the dim factor ($\xi 4$) of this basic lamp to be equal to 1, to calculate an optimum solution for the other three dim factors ($\xi 1_S$, $\xi 2_S$, $\xi 3_S$) as a function of the target chromaticity coordinates, for the maximum allowed value of the luminance for which $0 \leqq \xi \leqq 1$ applies for each of said dim factors ($\xi 1_S$, $\xi 2_S$, $\xi 3_S$);

wherein the controller is designed to calculate, for each of the four lamps, the weighed distance ($\Delta(i) = L(i) \cdot \sqrt{(x_T - x(i))^2 + (y_T - y(i))^2}$) between that lamps color point and the target color point (T), and to take as basic lamp the one lamp having the shortest weighed distance from the target color point (T).

3. Illumination system, comprising:

four lamps, each lamp generating light with a respective color point having color coordinates and having a nominal output intensity;

four lamp drivers associated with the respective lamps, each lamp driver capable of driving its corresponding lamp with a dim factor ($\xi 1$, $\xi 2$, $\xi 3$, $\xi 4$);

a common controller for generating control signals for the lamp drivers such as to control the dim factors ($\xi 1$, $\xi 2$, $\xi 3$, $\xi 4$) of the respective lamps;

wherein the controller is responsive to an input signal indicating a target color point (T) having target chromaticity coordinates by calculating target dim factors ($\xi 1_T$, $\xi 2_T$, $\xi 3_T$, $\xi 4_T$) and using these values for controlling the drivers;

wherein the controller is designed to select one of the lamps to be a basic lamp, to set the dim factor ($\xi 4$) of this basic lamp to be equal to 1, to calculate an optimum solution for the other three dim factors ($\xi 1_S$, $\xi 2_S$, $\xi 3_S$) as a function of the target chromaticity coordinates, for the maximum allowed value of the luminance for which $0 \leqq \xi \leqq 1$ applies for each of said dim factors ($\xi 1_S$, $\xi 2_S$, $\xi 3_S$), wherein the controller is designed to perform four calculation cycles, wherein in each calculation cycle a different lamp is selected to be the basic lamp, wherein in each calculation cycle different values are obtained for the maximum allowed luminance value, and wherein the highest one of these different values is taken as the optimum luminance value while the controller uses the dim factors ($\xi 1_S$, $\xi 2_S$, $\xi 3_S$, $\xi 4_S$),corresponding with said optimum luminance value to calculate the target dim factors ($\xi 1_T$, $\xi 2_T$, $\xi 3_T \xi 4_T$).

4. Illumination system according to claim 3, wherein the controller is responsive to an input signal indicating a target brightness ($B_T$) by calculating said target dim factors ($\xi 1_T$, $\xi 2_T$, $\xi 3_T \xi 4_T$) according to $\xi 1_T = B_T \cdot \xi 1_S$, $\xi 2_T = B_T \cdot \xi 2_S$, $\xi 3_T = B_T \cdot \xi 3_S$, $\xi 4_T = B_T \cdot \xi 4_S$.

* * * * *